US006404398B1

(12) United States Patent
Chen et al.

(10) Patent No.: US 6,404,398 B1
(45) Date of Patent: Jun. 11, 2002

(54) INDIRECT RADIATING ARRAY TECHNIQUES

(75) Inventors: Chun-Hong H. Chen, Torrance; Edward V. Koretzky, Rancho Palos Verdes; Steven S. Kuo, Torrance; David L. Brundrett, Culver City, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/640,450

(22) Filed: Aug. 17, 2000

(51) Int. Cl.[7] ..... H01Q 3/26; H01Q 15/23; H01Q 19/00

(52) U.S. Cl. ..... 343/754; 343/781 P; 342/368

(58) Field of Search ..... 343/753, 754, 343/755, 781 CA, 781 P; 342/368, 374; H01Q 15/00, 15/02, 3/26, 15/23, 19/06, 19/08, 19/10

(56) References Cited

U.S. PATENT DOCUMENTS 4,236,161 A * 11/1980 Ohm ..... 343/781 CA
5,576,721 A * 11/1996 Hwang et al. ..... 343/753
6,005,515 A 12/1999 Allen et al. ..... 342/374

* cited by examiner

*Primary Examiner*—Michael C. Wimer
(74) *Attorney, Agent, or Firm*—McAndrews, Held & Malloy, Ltd.

(57) ABSTRACT

An antenna system and method for transmitting or receiving a plurality of pixel beams of satellite communication signals. A focusing device (770) focuses pixel beams on individual antenna elements or horns (708 or 808) of the transmitter (700) or receiver (800). In the transmitter, each antenna element transmits a pixel beam, and in the receiver, each antenna element has focused on it an individual pixel beam.

18 Claims, 5 Drawing Sheets

INDIRECT RADIATING ARRAY TECHNIQUES

BACKGROUND OF THE INVENTION

The present invention relates generally to antenna systems. More specifically, the present invention relates to an improved method and apparatus for providing a shapeable and directable communication beam.

In satellite communication systems, it is desirable to shape and direct communication beams. The ability to shape and direct communication beams results in efficient use of the finite energy resources of communication satellites, increases communication bandwidth, and reduces interference between beams.

In addition, there is a corresponding increase in communication security. Communicating only with an intended geographical area substantially complicates message interception from geographical areas outside the intended area of communication.

In the past, satellite-based conventional phased arrays (CPAs) were developed that provided bandwidth to communication areas using spot beams (communication beams designed to cover specific areas or "spots" on the Earth's surface). Typically the spot beams were organized into a matrix of evenly shaped and spaced beams (also referred to as pixel beams) designed to provide a total coverage to a large geographical area, such as a state, a nation, or the Earth.

CPAs have fine steering capability, but are difficult to implement when many simultaneous beams are required. Further, CPAs suffer from sun in view of grating lobes, frequency-dependent pointing, and (in the receive case) amplifier compression from high-power jammers in the array element's global field of view.

The spot beams were generated using CPAs in which each radiating antenna element in the array has a corresponding independent radio-frequency (RF) phase shifting circuit for each spot beam produced. Thus, for example, in a communication system incorporating a CPA with 547 elements, 547 corresponding RF phase shifters determine the shape and direction of a single spot beam.

Because of the complexity associated with determining and implementing the large number of RF phase shifts associated with a single spot beam, communication systems typically fixed the shape and direction of the spot beams to predetermined values. The satellite communication system communicates with users in a spot beam area with a corresponding spot beam signal and communicates with users in another spot beam area with another corresponding spot beam signal.

Fixed spot beam communication systems suffer from beam shaping inflexibility. For a fixed spot beam communication system to provide communication bandwidth to an area, the system must provide communication bandwidth to each spot beam area containing a portion of the area. For example, if a desired area includes subsections of three spot beam areas, the system must provide communication bandwidth to the three entire spot beam areas, including the subsections of the three spot beam areas not included in the desired communication area.

Fixed spot beam communication systems also suffer from beam directing inflexibility. A fixed spot beam communication system provides maximum beam gain at the center of each spot beam. Thus, users near the perimeter of spot beam areas receive lower quality communication service than users near the center of spot beam areas. For example, if a desired communication area is centered between three spot beam areas, the system provides maximum quality coverage to the communication area by using all three corresponding spot beams. Unfortunately, in the attempt to provide high quality coverage to the communication area, the system also provides relatively large amounts of communication energy to the centers of the three spot beam areas where the communication energy is not needed or wanted.

U.S. Pat. No. 6,005,515 (Allen. et al., issued Dec. 21, 1999) describes a direct radiating array (DRA) that uses a "global pixel beams" concept to provide multiple communication beams to conveniently and reliably point a beam from one prescribed location to another without the complexity of large numbers of phase shifting circuits required by a conventional phased array (CPA) antenna system.

DRAs, which produce many simultaneous beams, can be easily implemented, but lack the fine-steering capability of the CPA. Further, DRAs suffer from the same problems as CPAs, namely, sun in view of grating lobes, frequency-dependent pointing, and amplifier compression from high-power jammers in the array element's global field of view.

U.S. application Ser. No. 09/443,526, entitled "Enhanced Direct Radiating Array," filed Nov. 19, 1999 in the names of Chun-Hong H. Chen, et al., now U.S. Pat. No. 6,295,026, describes an enhanced DRA (EDRA) by adding to U.S. Pat. No. 6,005,515 a fine pointing and beam shaping capability that is needed in many military and commercial satellite communication applications to maximize the coverage gain and thus increase the data rate and communication capacity. U.S. application Ser. No. 09/505,816, entitled "Nulling Direct Radiating Array," filed Feb. 17, 2000 in the name of Chun-Hong H. Chen, now U.S. Pat. No. 6,275,188, further extended the DRA concept to a nulling DRA (NDRA) useful in applications that require active anti-jamming capabilities. DRAs, EDRAs and NDRAs provide improvements over their predecessors, but still have limitations which may limit their usefulness in certain applications. For example, EDRAs suffer from the same problems as CPAs and DRAs, namely, sun in view of grating lobes, frequency-dependent pointing, and amplifier compression from high-power jammers in the array element's global field of view. This invention addresses such potential problems and provides a solution.

SUMMARY OF THE INVENTION

The preferred embodiment is useful in an antenna system for transmitting or receiving a plurality of pixel beams of satellite communication signals, including a first pixel beam and a second pixel beam. In such an environment, a preferred apparatus embodiment comprises a plurality of antenna array elements conducting element signals corresponding to the plurality of pixel beams. The antenna array elements include a first element and a second element. A focusing device is arranged to couple individual pixel beams of the plurality of pixel beams to individual elements of the plurality of antenna array elements. The first pixel beam is coupled to the first element and the second pixel beam is coupled to the second array element. A processing module is coupled to the element signals.

A preferred method embodiment of the invention is useful in an antenna system for transmitting or receiving a plurality of pixel beams of satellite communication signals, including a first pixel beam and a second pixel beam. The transmitting and receiving involves using a plurality of antenna array elements, including a first element and a second element. In such an environment, the method comprises focusing individual pixel beams of the plurality of pixel beams relative to individual elements of the plurality of antenna array elements, including focusing the first pixel beam relative to the first element and focusing the second pixel beam relative to the second element.

By using the foregoing techniques, satellite communication uplink applications can be implemented in a way which overcomes the potential problems discussed previously. That is, many simultaneous beams can be easily implemented, while maintaining the fine steering capability of the CPA. Moreover, the foregoing techniques do not suffer from the problems discussed above in connection with CPAs, DRAs and EDRAs.

DETAILED DESCRIPTION OF THE PREFERRED EMBODIMENTS

Figure 1:
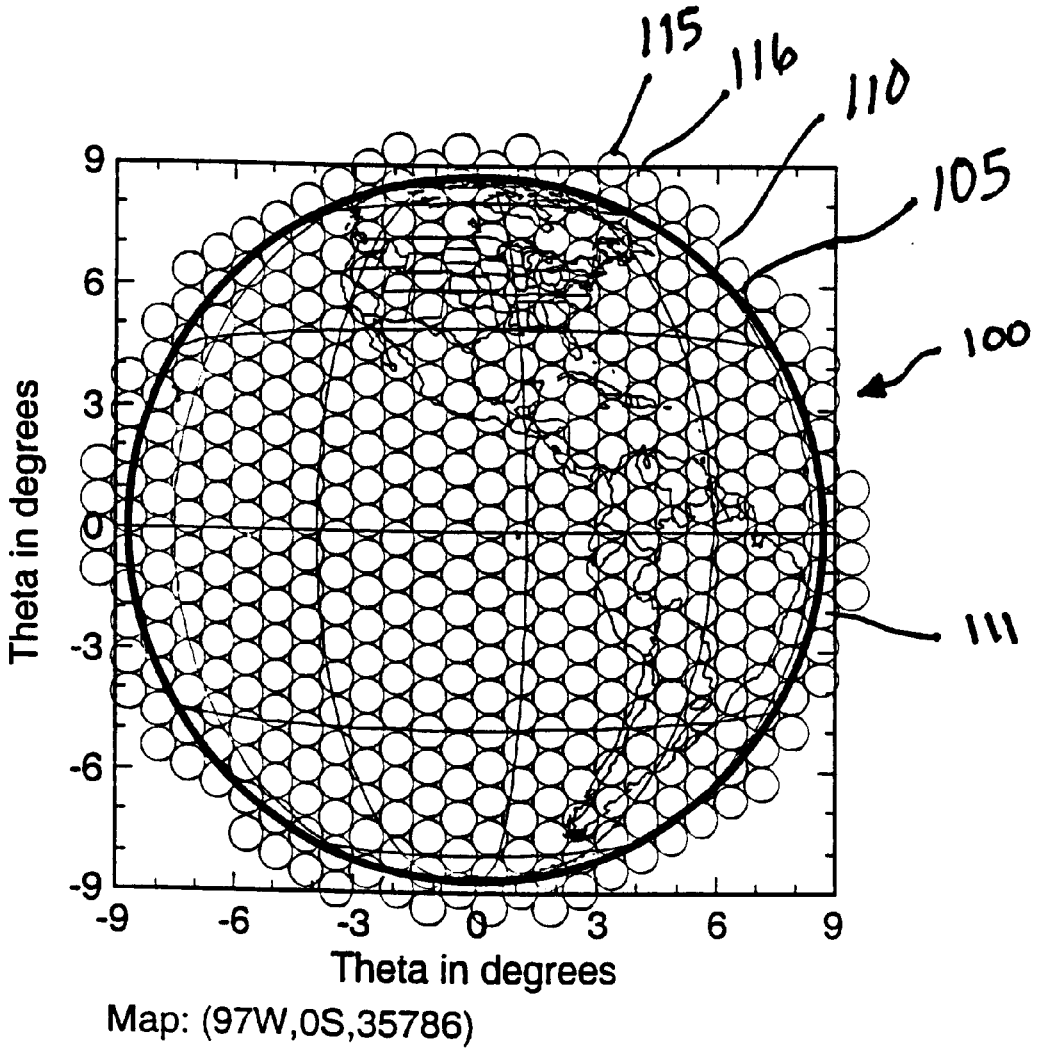
FIG. 1 is an example of an Earth field of view covered with 448 pixel beams having spacing between the adjacent pixel beams of about 0.87 degree.

FIG. 1 illustrates pixel beams (e.g., small spot beams) positioned to cover an earth field of view. In particular, FIG. 1 illustrates a far field view of the Earth 105 from geosynchronous Earth orbit. From geosynchronous Earth orbit, approximately 448 beams, such as the pixel beams 110 and 111, cover the far field view of the Earth 105. The spacing between the adjacent pixel beams is about 0.87 degree. Note that because of the shape of the array 100 of pixel beams, some of the pixel beams, such as the pixel beams 115 and 116, may cover areas just outside of the far field of view of the Earth 105.

Figure 2:
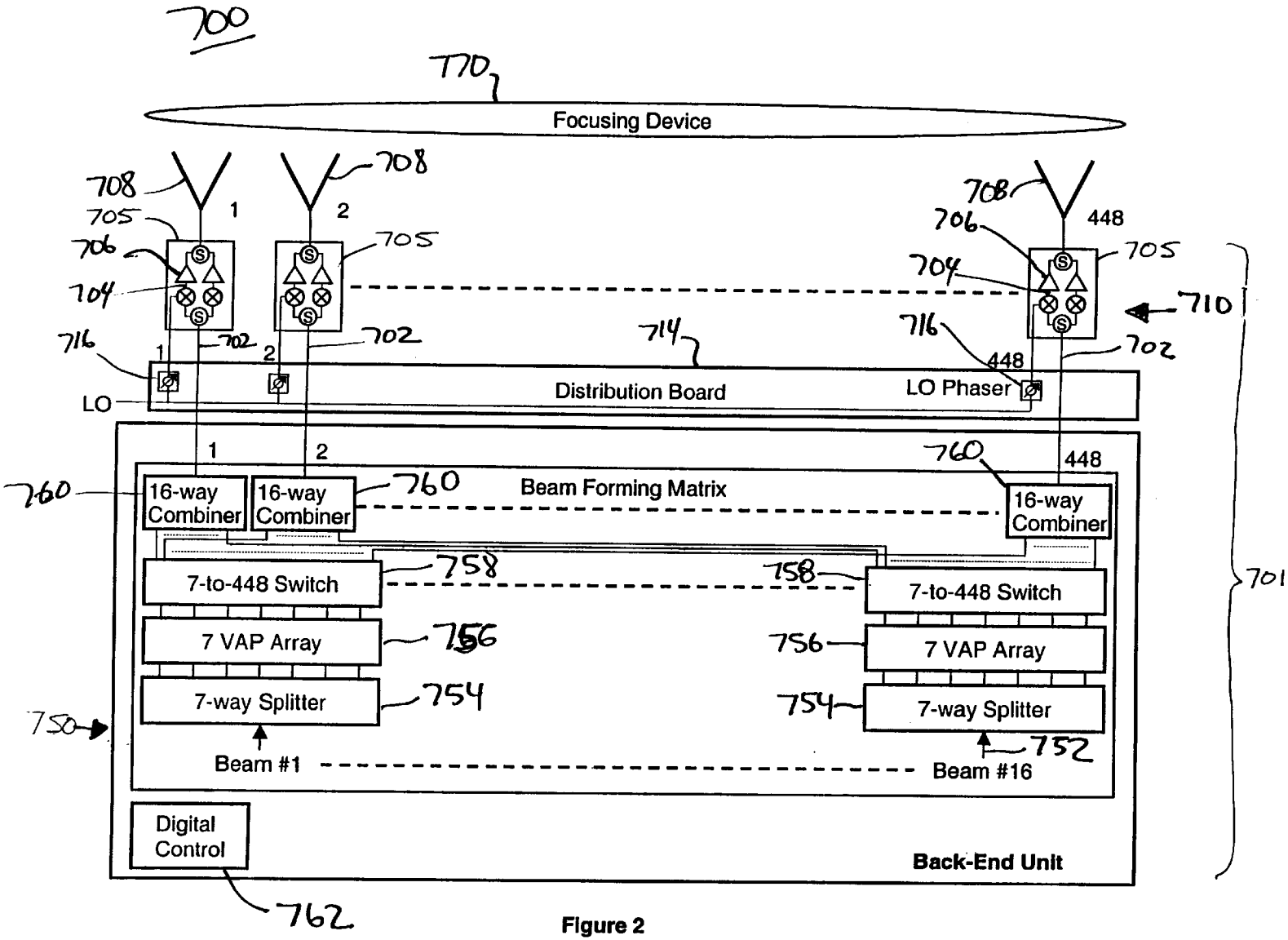
FIG. 2 is a schematic block diagram of a preferred embodiment of the invention in a transmitting configuration.

Referring to FIG. 2, a preferred embodiment of an indirect radiating array (IDRA) 700 is configured to perform a transmitting function, and thus will also be referred to as the transmit IDRA 700.

In general, FIG. 2 illustrates a focusing device (such as lens or reflector) 770 which replaces a matrix network or phase network and is placed in front of the array elements to perform the function of generating "global pixel beams". The module 705 shown in FIG. 2 is internally redundant to ensure system reliability.

Figure 4:
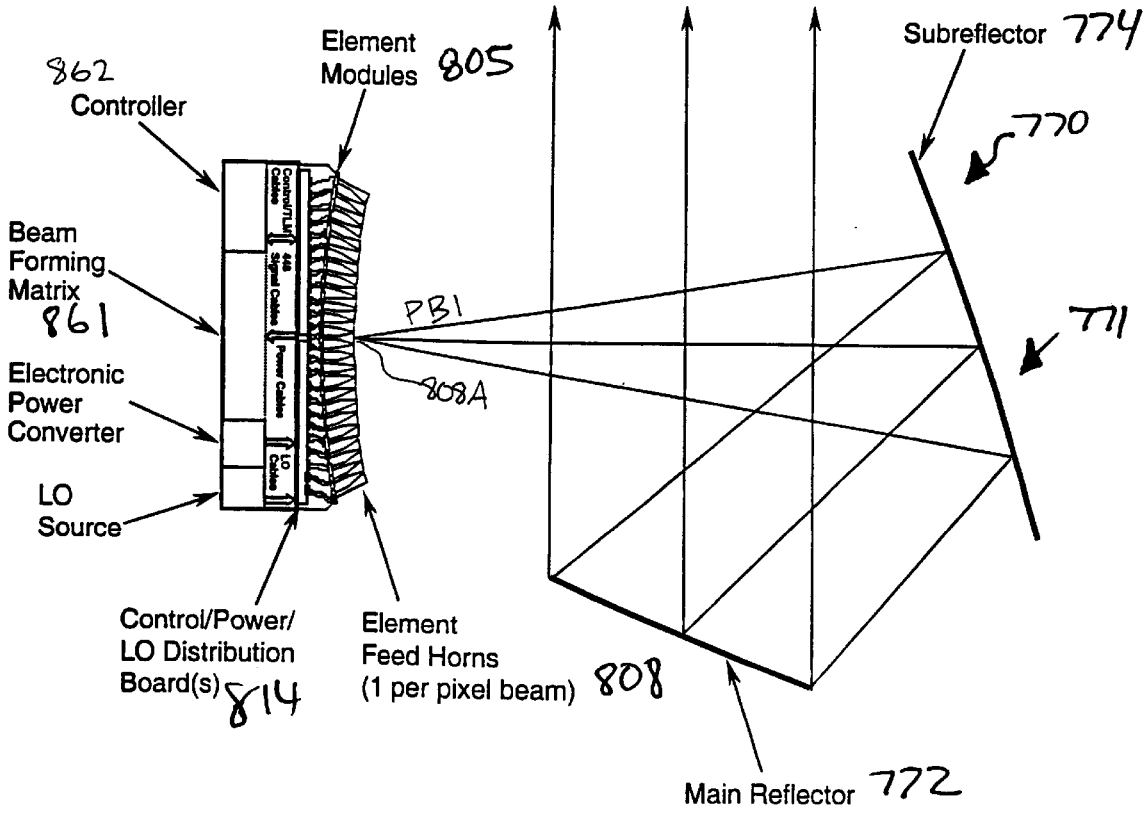
FIG. 4 is a schematic cross-sectional view of a preferred form of the focusing device shown in FIGS. 2 and 3 using a Side-fed Offset Cassegrain reflector.
Figure 5:
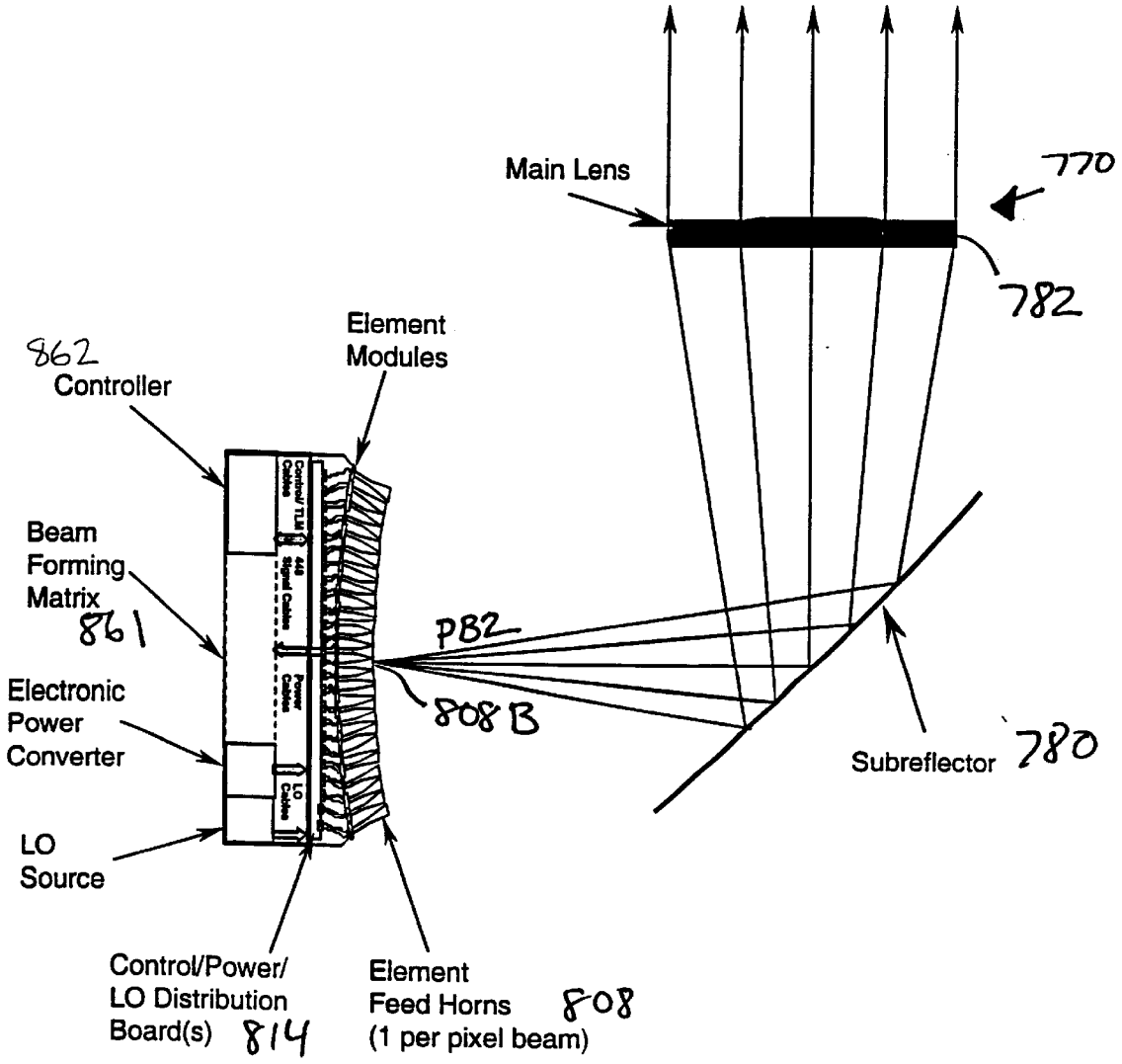
FIG. 5 is a schematic cross-sectional view of an alternative embodiment of the focusing device shown in FIGS. 2 and 3 using a reflector-lens arrangement.

The transmit IDRA 700 includes a focusing device 770 which may be configured as a reflecting antenna of the type shown in FIG. 4 or a lens type antenna shown in FIG. 5. IDRA 700 also includes a processing module 701 including a front-end unit 710 for transmitting signals (hereinafter referred to as element signals) through respective antenna array elements 708. A total of 448 array elements are provided in this embodiment. The front-end unit 710 includes element signal inputs (some of which are denoted by the label 702) coupled to the IF side of respective IF/RF converters (hereinafter "upconverters") (some of which are denoted by the label 704). The front-end unit 710 also includes solid-state power amplifiers (SSPAs) (some of which are denoted by the label 706) coupled to the RF side of the respective upconverters 704. The SSPAs 706, in turn, drive respective antenna array elements (denoted by label 708).

The front-end unit 710 also includes a local oscillator/DC power/intermediate frequency (LO/DC/IF) distribution board 714 with oscillator outputs preferably equal in number to the upconverters 704. Local oscillator (LO) phasers 716, equal in number to the upconverters 704, couple the oscillator outputs of the local oscillator distribution board 714 to respective upconverters 704.

The front-end unit 710 receives element signals at the element signal inputs 702. The element signals are typically intermediate frequency (IF) signals. Each element signal corresponds to a pixel beam of the type illustrated in FIG. 1. The upconverters 704 receive the element signals from the respective element signal inputs 702. The upconverters 704 also receive phase-adjusted LO signals from the respective LO phasers 716. The upconverters 704 use the phase-adjusted LO signals to convert the received IF element signals to radio frequency (RF) element signals. The upconverters 704 then output the RF element signals to the SSPAs 706 for amplification and transmission through the antenna array elements 708.

Each input 702 is connected to a 16-way combiner, some of which are numbered 760. A total of 448 combiners 760 are provided.

Additional details about the front-end unit 710 may be found in U.S. patent application Ser. No. 09/289,414, filed Apr. 4, 1999, titled "Multiple Scanning Beam Direct Radiating Array and Method for Its Use", U.S. Pat. No. 6,005,515, which is incorporated herein by reference in its entirety.

The IDRA 700 also includes a back-end unit 750 for forming shapeable and directable composite beams as described in U.S. application Ser. No. 09/443,526, now U.S. Pat. No. 6,295,026. The back-end unit 750 includes sixteen communication channel ports 752 coupled to sixteen corresponding 7-way signal splitters 754. The signal splitters 754 also are coupled to sixteen respective variable amplitude and phase arrays 756. Sixteen 7-to-448 switches 758 couple the variable amplitude and phase arrays 756 to the combiners 760.

The back-end unit 750 receives input communication signals through the communication channel inputs 752. The communication signals input to the back-end unit 750 are the signals to be communicated over corresponding shapeable and directable composite beams.

The signal splitters 754 receive the communication signals from the respective communication signal inputs 752. The signal splitters 754 split the communication signals into sets of intermediate signals equal in number to the maximum number of pixel beams used to form a composite beam. For the IDRA 700 illustrated in FIG. 2, the maximum number of pixel beams used to form a communication beam is seven. Thus, the signal splitters 754 split the communication signals into sets of seven intermediate signals.

The variable amplitude and phase arrays 756 receive the sets of intermediate signals from their respective signal splitters 754. The variable amplitude and phase arrays 756 adjust the amplitude and phase of the intermediate signals to create pixel signal components for each of the pixel beams used to form the composite beam of the desired shape and in the desired direction. The variable amplitude and phase arrays 756 may, for example, include arrays of variable amplitude and phase devices (VAPs). Each VAP may, in turn, include a phase shifter and a variable attenuator.

The switching networks 758 receive the pixel signal components from the respective variable amplitude and phase arrays 756 and routes each of these pixel signal components to a single predetermined combiner 760. For the IDRA 700 embodiment illustrated in FIG. 2, the composite beam is formed from seven pixel beams. The combiners 760 couple the appropriate signals to inputs 702. The IDRA 700 is extendable to provide composite beam formation using any number of pixel beams in the system.

A communication signal traces a particular path through the IDRA 700. For example, a signal flows from the input channel #1 of the IDRA 700 through the splitter 754 corresponding to input channel #1 (where the signal is split into a set of seven intermediate signals). The corresponding variable amplitude and phase array 756 receives the intermediate signals and adjusts the amplitudes and phases of the intermediate signals to form as many as seven pixel signal components. The corresponding switching network 758 then routes each of the pixel signal components to a single predetermined combiner 760.

The front-end unit 710 receives the set of element signals at the corresponding set of inputs 702. The upconverters 704 corresponding to the set of element signal inputs convert the set of IF element signals received from the interconnecting network 702 to a set of RF element signals. The corresponding SSPAs 706 subsequently amplify the set of RF element signals and transmit the set of RF element signals through the corresponding antenna array elements 708.

The operation of transmit configuration is controlled by a conventional digital control 762 which may be implemented by a microprocessor, microcontroller, digital signal processor or other logic unit capable of arithmetic and logic operations.

Figure 3:
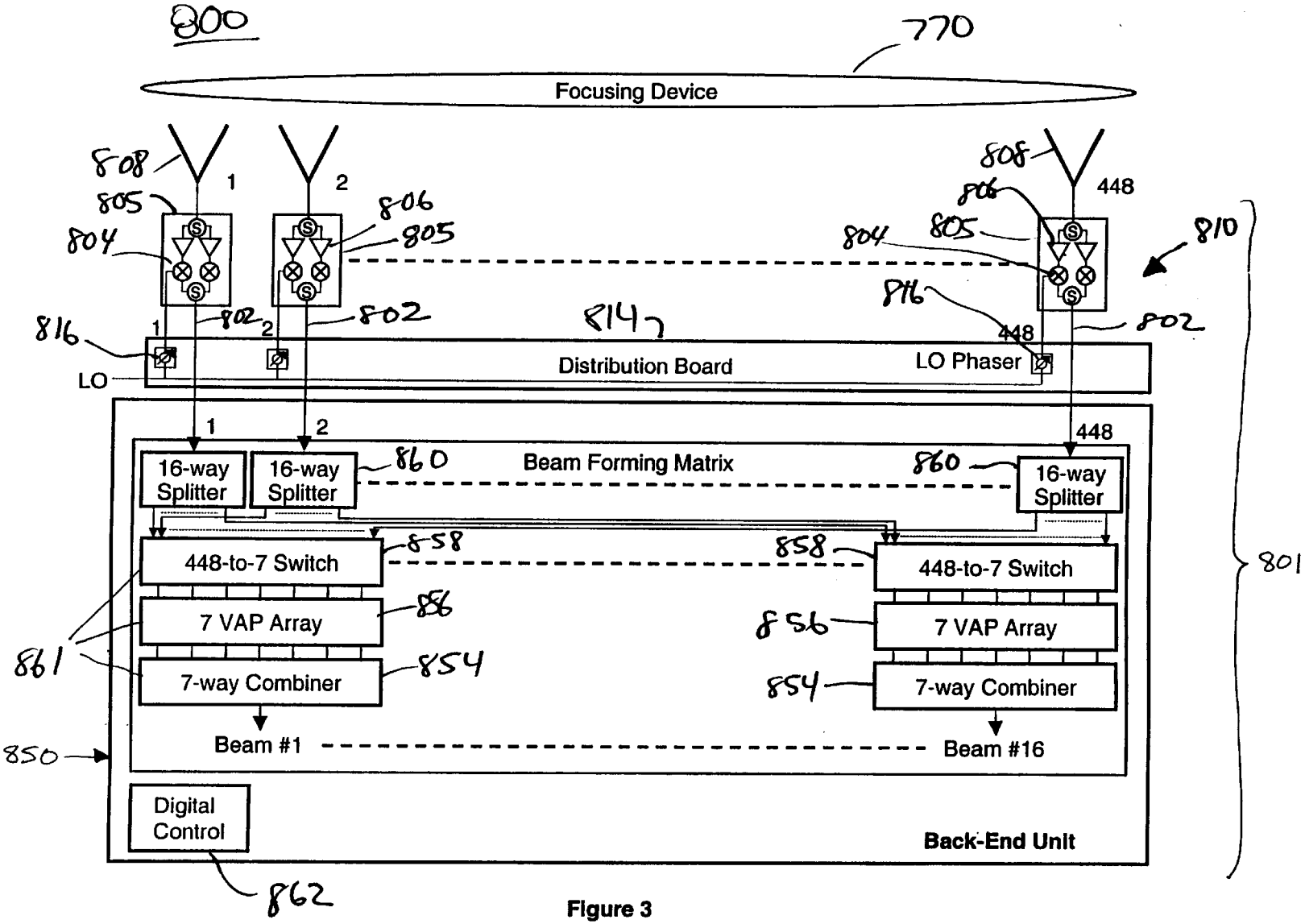
FIG. 3 is a schematic block diagram of a preferred embodiment of the invention in a receiving configuration.

FIG. 3 shows a block diagram for an IDRA 800 in a receiving configuration (hereinafter "receive IDRA 800") according to a preferred embodiment of the present invention. The receive IDRA 800 is similar to the transmit IDRA 700 illustrated in FIG. 2.

The receive IDRA 800 comprises a processing module 801 including a front-end unit 810 similar to the front-end unit 710 of the transmit IDRA 700. The front-end unit 810 of the receive IDRA 800, however, includes low noise amplifiers (LNAs) (some of which are denoted by the label 806) in place of the SSPAs 706 of the transmit IDRA 700. The LNAs are designed to have high IP3 and survivable input power level to handle high input power. The front-end unit 810 of the receive IDRA 800 also includes downconverters (some of which are denoted by the label 804) in place of the upconverters 704 of the transmit EDRA 700.

The front-end unit 810 receives RF element signals through the antenna array elements 808. Elements 808 comprised of 448 feed horns, one for each pixel beam to be received by the antenna. The feed horns may be constructed as described in U.S. application Ser. No. 09/232,452, entitled "A Compact Side-Fed Dual Reflector Antenna System For Providing Adjacent, High Gain Antenna Beams," filed Jan. 15, 1999 in the names of Ann L. Peebles, et al., now U.S. Pat. No. 6,211,835, assigned to a common assignee and incorporated by reference in its entirety into this application. Antenna elements 708 shown in FIG. 2 also may be constructed in the same manner as elements 808. The LNAs 806 receive the RF element signals from their respective antenna array elements 808 and amplify the RF element signals. The downconverters 804 convert the amplified RF element signals from the LNAs 806 to IF element signals. LNAs 806 and downconverters 804 jointly form element modules 805. The front-end unit 810 then outputs the IF element signals to connectors, such as 802, which are coupled to a back end unit 850.

The back-end unit receives the 448 pixel signals from connectors 802 and converts each of the 448 pixel signals to as many as sixteen communication signals in 16-way splitters, some of which are numbered 860.

The back-end unit 850 also includes a set of sixteen 448-to-7 switches 858 coupled to the signal splitters 860. The back-end unit 850 further includes a set of sixteen variable amplitude and phase arrays 856, which may include arrays of seven variable amplitude and phase devices (VAPs), interposed between switches 858 and a corresponding set of sixteen 7-way combiners 854.

The back-end unit 850 receives pixel signals from connectors 802. The 16-way splitters 860 split each of the received pixel signals sixteen ways and provide one of the sixteen split received pixel signals to each of the sixteen switches 858. This enables each of the sixteen communication channels of the back-end unit 850 to access pixel signals from any of the 448 pixel beams.

Each of the sixteen switches 858 corresponds to a unique one of the sixteen communication channels. For the receive IDRA 800 illustrated in FIG. 3, each of the 16 composite beams, corresponding to the 16 communication channels, may be formed from as many as seven of the 448 pixel beams. Accordingly, each of the switches 858 passes seven of the 448 pixel signals to a corresponding variable amplitude and phase array 856.

The variable amplitude and phase arrays 856 provide the capability to modify the amplitude and phase of each of the pixel signals passed by the respective switches 858. The variable amplitude and phase arrays 856 output the pixel signals, any number of which may be modified in amplitude and phase, to the corresponding 7-way combiners 854.

The combiners 854 combine the pixel signals received from the variable amplitude and phase arrays 856 to form communication signals. The combination of a switch 858, a variable amplitude and phase array 856, and a combiner 854 (each corresponding to a single communication channel) may be referred to, in aggregate, as a beam forming matrix or unit 861.

The receive IDRA 800 may be extended to form communication beams from any number of the total number of pixel beams in the system.

The remainder of the elements in FIG. 3 may be understood from the description of the corresponding components described in connection with FIG. 2. The elements in FIG. 3 are given numbers indexed by 100 compared to the corresponding elements in FIG. 2.

FIG. 4 illustrates in more detail the preferred form of focusing device 770 shown as a block in FIGS. 2 and 3. In general, a simple reflector or lens antenna as shown in FIGS. 4 and 5, can implement our concept and perform the function as illustrated in FIGS. 2 and 3. In reality, to close a wideband, high data rate communication link between satellite and a smaller terminal user who could be anywhere on earth, narrow pixel beams are necessary which dictates the use of a large aperture reflector or lens.

Narrowing the pixel beams under the constraint of scanning to the edge of the earth suggests using a long focal length in order to mitigate scan loss. Additionally, in order to combine a subset of pixel beams into a well formed composite beam, the pixel beams need to be placed sufficiently close to one another. This also requires a suitably long focal length to accommodate the size of the feed horn and electronics. In general, the use of a long focal length increases the size of the overall antenna structure.

To combat the increased size, a side fed offset Cassegrain (SFOC) multiple beam antenna (MBA) 771 is preferred. This particular arrangement provides a compact design with the benefits of a long focal length. The side-fed offset Cassegrain (SFOC) antenna 771 includes a main reflector 772 and a subreflector 774 arranged as shown in FIG. 4. Each of the 448 pixel beams approaches focusing device 770 from a slightly different angle and is focused onto a different one of antenna elements 808. For example, pixel beam PB1 is focused on antenna element or horn 808A. The remaining components shown in FIG. 4 correspond to the like-numbered components previously described in connection with FIG. 3. The antenna shown in FIG. 4 has a weight advantage over the antenna shown in FIG. 5.

FIG. 5 illustrates an alternative lens embodiment of focusing device 770 which includes a subreflector 780 and a main lens 782. The lens and subreflector focus each pixel beam on a different one of the antenna elements or horns 808 in a well known manner. For example, pixel beam PB2 is focused on antenna element 808B. The remaining elements shown in FIG. 5 are like those previously explained in FIG. 4.

Although FIGS. 4 and 5 have been explained in terms of a receiving antenna, those skilled in the art will recognize that the same principles apply to a transmitting antenna. When the focusing devices are used with transmitter 700, each of the antenna elements or horns transmits a separate element signal which is focused by device 770 into a separate pixel beam that is transmitted into space. The pixel beams are directed in slightly different directions to result in an array of pixel beams, such as the array shown in FIG. 1. Thus, the FIGS. 4 and 5 antennas can be used with either the transmitter shown in FIG. 2 or the receiver shown in FIG. 3.

While particular elements, embodiments and applications of the present invention have been shown and described, it will be understood that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An antenna system for transmitting or receiving a plurality of pixel beams of satellite communication signals, including a first pixel beam and a second pixel beam, said system comprising in combination;

a plurality of antenna array elements conducting element signals corresponding to said plurality of pixel beams, said antenna array elements including a first element and a second element;

a focusing device arranged to couple individual pixel beams of said plurality of pixel beams to individual elements of said plurality of antenna array elements, including coupling said first pixel beam to said first array element and said second pixel beam to said second array element; and a processing module coupled to said element signals, said processing module including variable amplitude and phase devices to coordinate the pixel beams with a desired direction.

2. A system, as claimed in claim 1, wherein said focusing device comprises a reflector.

3. A system, as claimed in claim 2, wherein said focusing device comprises a plurality of reflectors.

4. A system, as claimed in claim 2, wherein said focusing device comprises a Side-fed offset Cassegrain device.

5. A system, as claimed in claim 1, wherein said focusing device comprises a lens.

6. A system, as claimed in claim 5, wherein said focusing device comprises a reflector coupled between said lens and said antenna array elements.

7. A system, as claimed in claim 1, wherein said array elements are arranged to generate said pixel beams from said element signals, wherein said focusing device is arranged to transmit said pixel beams into space and wherein said variable amplitude and phase devices provide a steering capability.

8. A system, as claimed in claim 7, wherein said processing module generates said element signals from communication signals.

9. A system, as claimed in claim 1, wherein said array elements are arranged to generate said element signals from said pixel beams received from said focusing device.

10. A system, as claimed in claim 9, wherein said processing module generates communication signals from said element signals.

11. A system, as claimed in claim 1, wherein said antenna array elements comprise a plurality of horns.

12. A system, as claimed in claim 1, wherein said focusing device comprises a plurality of lenses.

13. In an antenna system for transmitting or receiving a plurality of pixel beams of satellite communication signals, including a first pixel beam and a second pixel beam, by using a plurality of antenna array elements, including a first element and a second element, a method comprising focusing individual pixel beams of said plurality of pixel beams relative to individual elements of said plurality of antenna array elements, including focusing said first pixel beam relative to said first element and focusing said second pixel beam relative to said second element, and generating amplitude and phase adjustment signals to coordinate the pixel beams with a desired direction.

14. A method, as claimed in claim 13, wherein said focusing comprises reflecting.

15. A method, as claimed in claim 13, wherein said system comprises a lens and wherein said focusing comprises focusing with said lens.

16. A method, as claimed in claim 15, wherein said focusing further comprises reflecting.

17. A method, as claimed in claim 13, wherein said system is arranged as a receiver and wherein said method further comprises:

generating element signals corresponding to said pixel beams; and processing said element signals to generate communication signals.

18. A method, as claimed in claim 13, wherein said system is arranged as a transmitter and wherein said method further comprises:

receiving composite beam signals;

processing said composite beam signals to form element signals; and transmitting said pixel beams in response to said element signals and said amplitude and phase adjustment signals to provide a steering capability.

* * * * *